United States Patent [19]

Pinch

[11] 4,004,294

[45] Jan. 25, 1977

[54] DISGUISED NURSING GARMENT

[75] Inventor: Louise C. Pinch, Seattle, Wash.

[73] Assignee: Duane E. Oleson, Lake Oswego, Oreg.

[22] Filed: Mar. 4, 1976

[21] Appl. No.: 664,007

[52] U.S. Cl. ..... 2/104; 128/460

[51] Int. Cl.[2] ..... A41D 1/20

[58] Field of Search ..... 2/104, DIG. 6; 128/460

[56] References Cited

UNITED STATES PATENTS

| | | | |
|---|---|---|---|
| 890,614 | 6/1908 | Culver | 2/104 |
| 1,098,155 | 5/1914 | Knapp | 2/104 |
| 1,290,142 | 1/1919 | Elowski | 2/104 |

FOREIGN PATENTS OR APPLICATIONS

| | | | |
|---|---|---|---|
| 682,391 | 5/1930 | France | 2/104 |

*Primary Examiner*—Andrew V. Kundrat
*Assistant Examiner*—Doris L. Troutman
*Attorney, Agent, or Firm*—Chernoff & Vilhauer

[57] ABSTRACT

A conventional women's blouse, dress or similar outer garment is provided with a pair of openings through the respective breast panels thereof, the openings being removably covered by material disguised as pockets. Each pocket-like covering comprises a bottom flap secured to the breast panel along the bottom edge of the opening so as to fold downwardly along such edge, a top flap secured along the top edge of the opening so as to fold over the bottom flap when in its upright position and detachably connect to it, and curly pile fabric loop and hook fastener strips disposed along each side of the opening and bottom flap respectively for detachably connecting the sides of the bottom flap continuously to the sides of the opening in an overlapping fashion which conceals the fastener strips.

5 Claims, 1 Drawing Figure

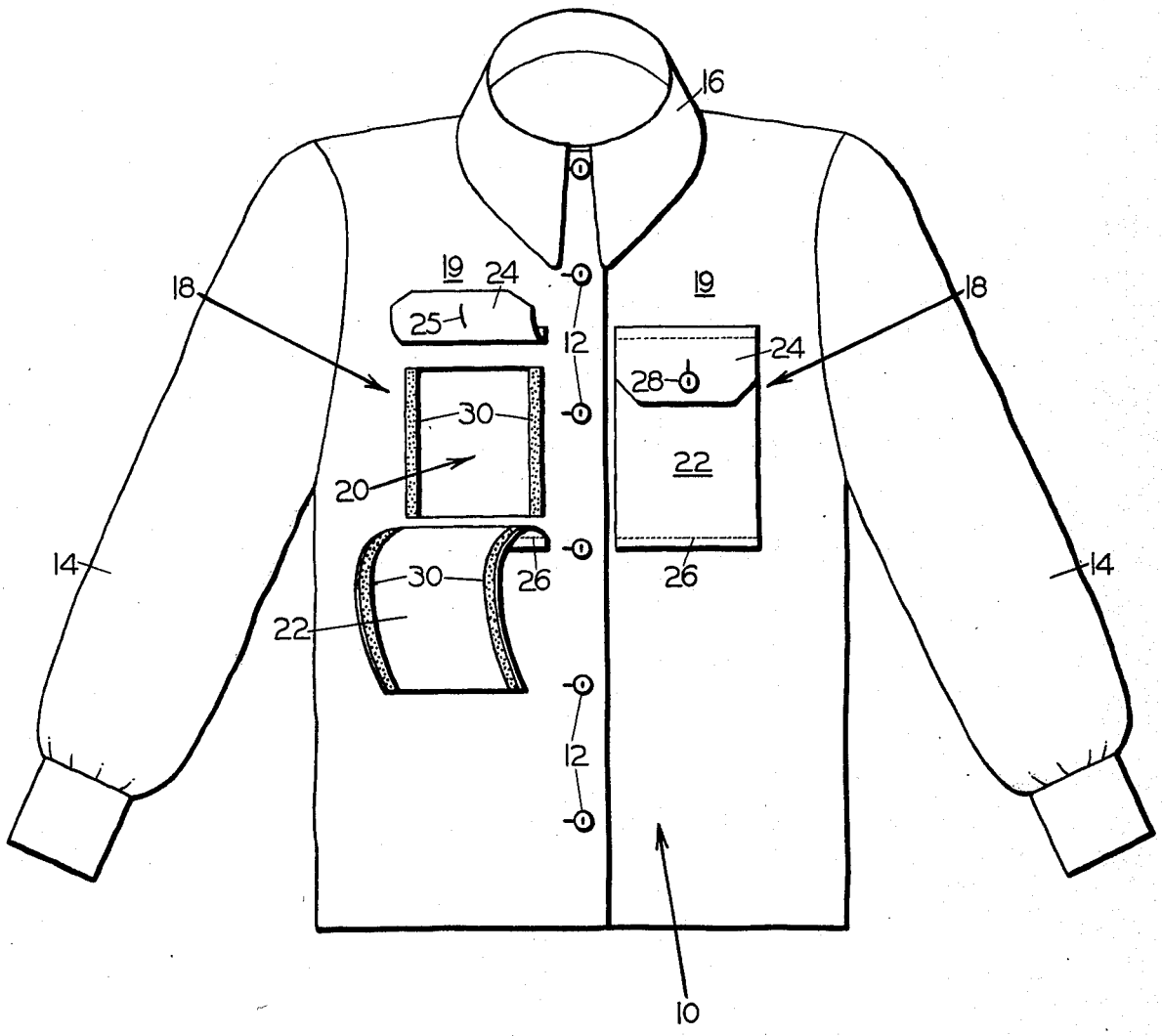
16
19
24
19
18
18
25
12
24
28
30
22
20
14
14
30
26
26
22
12
10

DISGUISED NURSING GARMENT

BACKGROUND OF THE INVENTION

This invention relates to apparel for facilitating a mother's nursing of her child while minimizing the exposure of her breasts, and more particularly to attractive blouses, dresses or similar outer garments having disguised openings through the breast portions thereof.

It is generally important to a mother when nursing her child that it may be accomplished conveniently, to minimize the discomfort to her child and its interference with her other activities, and with an appropriate degree of modesty, particularly when the nursing takes place within the view of other persons. It is therefore helpful to a nursing mother to wear apparel which is structurally designed to provide nursing convenience and maintain modesty, yet which is attractively disguised to belie its role in facilitating nursing.

Numerous types of apparel have previously been designed for facilitating nursing to some degree. For example Meyers U.S. Pat. No. 3,611,439 discloses a nursing gown which utilizes a pair of breast-covering panels which are detachably secured at their tops and fixedly secured at their bottoms for swinging downwardly to uncover the wearer's breast for nursing. However, due to the shape and structure of the panels and particularly the straps which support the front of the garment when the panels are folded down, which together form a deep V-neckline, the appropriateness of the gown is somewhat limited to use as a nightgown or a formal gown, and it would not ordinarily permit use as casual or every-day working wear nor provide any appreciable degree of protection against breast exposure when a panel is folded down. Marino U.S. Pat. No. 3,176,692 discloses a bra-slip which provides a pair of outer breast-covering flaps which swing downwardly to expose the wearer's breast for nursing, but this apparel is designed as an undergarment, not outer wear, and accordingly the function of the breast-covering outer flaps and their attachment mechanisms is outwardly apparent and unattractive. Also, Crane U.S. Pat. No. 1,626,024 discloses a dress which facilitates nursing by providing an elongate narrow opening, over at least one breast portion, which is covered by a flap resembling a handkerchief pocket. The flap is stitched along one side to the dress and attached by several clasps at the other side so that it may be folded to the stitched side to expose the opening for nursing. While this approach lends some attractiveness to the dress by disguising the breast opening with a pocket, the sideways opening of the flap is inconvenient since it must be held open by the mother during nursing, and the fact that the flap is not continuously secured at the opposite edge permits a gaping opening if the wearer assumes certain positions and tends to reveal the non-genuine, camouflage nature of the flap. Moreover the elongate narrow opening behind the flap is insufficiently large for convenient access by the child to the mother's breast.

Accordingly, there is a need for an attractive outer garment appropriate for casual and working wear which provides both greater convenience and modesty for a nursing mother than prior garments while simultaneously disguising its nursing function in a highly attractive and effective manner.

SUMMARY OF THE INVENTION

The present invention satisfies the aforementioned need by providing, in a conventional loose-fitting blouse, dress or similar outer garment of short-sleeve, long-sleeve or sleeveless design, a pair of large, generally rectangular openings through the breast panels covered by downwardly openable rectangular flaps attractively disguised as conventional breast pockets, such flaps being detachably secured along their respective vertical edges to the vertical edges of the rectangular openings.

The openings, which are almost as large as the "pockets" themselves for permitting easy access of the nursing child to the breasts, are each covered by one of the aforementioned flaps which is stitched to the front of the blouse along the bottom edge of its respective opening so that it will swing downwardly. A top flap, like a conventional pocket cover, is stitched along the top of the opening to fold over the bottom flap when in its upright position covering the opening. The top flap buttons to the bottom flap to ensure that the bottom flap will not come loose and uncover the breast inadvertently. In addition, each bottom flap is secured along its vertical side edges to the side edges of its opening by concealed continuous detachable fasteners, preferably strips of curly pile fabric loops and mating strips of hooks, so as to lend credibility to the appearance of the flaps as true stitched pockets and ensure that the wearer's breast will not unintentionally be exposed from the side regardless of the posture or position of the wearer.

It is therefore a principal objective of the present invention to provide an improved, attractive women's casual outer garment for facilitating nursing.

It is a further objective of the present invention to provide such an outer garment which renders nursing particularly convenient and preserves the modesty of the wearer, and whose nursing-facilitating function is fully and attractively disguised.

The foregoing objectives, features and advantages of the present invention will be more readily understood upon consideration of the following detailed description of the invention taken in conjunction with the accompanying drawings.

BRIEF DESCRIPTION OF THE DRAWING

The single FIGURE is a front view of a long-sleeve blouse embodiment of the present invention showing one breast cover in its open disposition and the other in its closed disposition disguised as a breast pocket.

DETAILED DESCRIPTION OF THE INVENTION

Referring to the FIGURE, a conventional women's long-sleeve, loose fitting, casual blouse is shown having a front portion 10 and a back portion, not shown, attached to the front portion at the top and sides thereof for covering the wearer's torso. The front portion may open in the middle and be fastened by buttons 12 or similar fasteners for donning the blouse. Alternatively, the blouse could be designed as a slip-over garment which does not require an opening in the front, or include an integral skirt portion thereby constituting a dress. As is well known to the art, the blouse may or may not be provided with sleeves such as 14 and a collar such as 16, as is desired for a particular style.

Ostensibly the blouse has a pair of conventional pockets 18 mounted on the breast panels 19 thereof. In actuality, these "pockets" each comprise a substantially rectangular opening 20 through a breast panel of the blouse, approximately the size of the pocket, a substantially rectangular bottom flap 22, having an exterior button 28 near its top, for covering the opening 20, and a top flap 24 having a button hole 25, like a pocket cover, which folds over the bottom flap in its upright position and securely attaches thereto. The bottom flap 22 is stitched to the front of the blouse at 26 along the bottom edge of the opening 20 so that it will swing downwardly to uncover the opening and remain out of the way during nursing without any effort on the part of the wearer.

When the bottom flap is in its upright position covering its opening 20, its top edge is covered by the top flap 24 and attached thereto by the button 28 which must be manipulated by hand to be released, thereby securely fastening the flap over the opening and preventing accidental exposure of the wearer's breast. This structural arrangement appears to be identical to a typical breast pocket having a button-down cover, and thereby lends credibility to the disguise.

The bottom flap 22 is wider than the opening 20 such that the flap's side edges overlap the side edges of the opening when the flap is in its upright position. Mating fasteners 30 extend continuously along the respective overlapping portions of the side edges further to ensure the appearance of the flaps as stitched pockets and to guard against exposure of the wearer's breasts from the side of the "pockets." The fasteners 30 preferably should comprise curly pile loop and hook-type self-gripping strip fasteners sold under the trademark VELCRO, with either the hook or loop strips mounted on the bottom flap and the other mounted on the blouse front in hidden, mutually overlapping relation when the bottom flap is closed. The outer boundaries of the strips should be inset laterally from the vertical edges of the bottom flap to ensure that the strips are completely concealed when the bottom flap is in its upright position.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A disguised nursing outer garment comprising a front portion and a back portion fastened together at the tops and sides thereof to cover a woman's torso, said front portion having a pair of openings formed therein, each said opening having a bottom edge, a top edge and two side edges, respective bottom flaps attached to said front portion along said bottom edge of each said opening and adapted to swing upwardly across said opening overlapping said two side edges thereof, and fastener means on said front portion of said garment and on said bottom flaps respectively for detachably connecting each of said bottom flaps to said front portion of said garment along each side edge of a respective one of said openings, said fastener means comprising mating strips of curly pile loop and hook fastener material attached to said bottom flaps and side edges of said openings respectively so that said mating strips overlap one another continuously along the overlapping portions of said flaps and side edges of said openings when said bottom flaps are in their upward positions.

2. The nursing garment of claim 1 further including means on each said bottom flap for detachably connecting the tops of said flaps to said front portion of said garment when said bottom flaps are in their upward position.

3. The nursing garment of claim 1 wherein said mating strips of fastener material are attached to said bottom flaps and side edges of said openings such that the outer lateral boundaries of the strips are inset laterally from the outer lateral boundaries of said respective bottom flaps.

4. The nursing garment of claim 1 further including respective top flaps attached to said front portion adjacent said top edge of each said opening and adapted to swing downwardly over said bottom flap in overlapping relation thereto when said bottom flap is in its upward position, and means on said respective flaps for detachably connecting said top and bottom flaps together when in said overlapping relation to one another.

5. The nursing garment of claim 4 wherein said means for detachably attaching said top and bottom flaps together comprises a button mounted on said bottom flap and a buttonhole formed in said top flap.

* * * * *